US006527531B2

(12) United States Patent
Fujita et al.

(10) Patent No.: US 6,527,531 B2
(45) Date of Patent: Mar. 4, 2003

(54) SCROLL COMPRESSOR HAVING STEP PORTIONS FOR REDUCING LEAKAGE OF FLUID

(75) Inventors: Katsuhiro Fujita, Nishi-kasugai-gun (JP); Makoto Takeuchi, Nagoya (JP); Takahide Itoh, Nagoya (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 10/040,630

(22) Filed: Jan. 9, 2002

(65) Prior Publication Data

US 2002/0094291 A1 Jul. 18, 2002

(30) Foreign Application Priority Data

Jan. 16, 2001 (JP) ..... 2001-007851

(51) Int. Cl.[7] ..... F01C 1/02
(52) U.S. Cl. ..... 418/552
(58) Field of Search ..... 418/55.2, 55.1

(56) References Cited

U.S. PATENT DOCUMENTS 4,457,674 A * 7/1984 Kawano et al. ..... 418/55.2
4,477,238 A * 10/1984 Terauchi ..... 418/55.2
4,722,676 A * 2/1988 Sugimoto ..... 418/55.4

FOREIGN PATENT DOCUMENTS

JP 58030494 A * 2/1983 ..... F04C/18/02
JP 61197787 A * 9/1986 ..... F04C/18/02
JP 04311693 A * 11/1992 ..... F04C/18/02

OTHER PUBLICATIONS

U.S. patent application Ser. No. 09/985,493, filed Nov. 5, 2001, pending.
U.S. patent application Ser. No. 10/040,630, filed Jan. 9, 2002, pending.
U.S. patent application Ser. No. 10/040,622, filed Jan. 9, 2002, pending.
U.S. patent application Ser. No. 10/049,911, filed Feb. 20, 2002, pending.
U.S. patent application Ser. No. 10,049,903, filed Feb. 20, 2002, pending.

* cited by examiner

*Primary Examiner*—Thomas Denion
*Assistant Examiner*—Theresa Trieu
(74) *Attorney, Agent, or Firm*—Oblon, Spivak, McClelland, Maier & Neustadt, P.C.

(57) ABSTRACT

A scroll compressor for reducing fluid leakage at step portions of scroll members and improving the compression efficiency is disclosed. The reduction of leakage and a high compression efficiency can be realized without increasing the precision in the manufacture of the members. Between the engaged scroll members, a high-pressure space is formed close to the spiral center, and among points at which the spiral walls contact with each other immediately before the innermost closed space communicates with the high-pressure space, the innermost point is defined as a base point. The angular distance from the base point to the outer end of the spiral, measured along the inner-peripheral face of the spiral wall, is approximately 4π rad. The angular distance from the base point to the step portion of each end plate, measured along the inner-peripheral face of the spiral wall, is equal to or more than approximately 3π rad.

1 Claim, 8 Drawing Sheets

SCROLL COMPRESSOR HAVING STEP PORTIONS FOR REDUCING LEAKAGE OF FLUID

BACKGROUND OF THE INVENTION

1. Field of the Invention

The present invention relates to a scroll compressor which is built into an air conditioner, refrigerating machine, or the like, and in particular, relates to the shape of scroll members therein.

2. Description of the Related Art

FIG. 8 is a cross-sectional view of a well-known scroll compressor. This scroll compressor comprises a fixed scroll member 101 which is fixedly attached to a housing 100 and a revolving scroll member 102 which is revolutionarily freely supported in the housing 100.

The fixed scroll member 101 has a fixed end plate 101*a* and a spiral wall 101*b*, and the revolving scroll member 102 has a revolving end plate 102*a* and a spiral wall 102*b*. The fixed and revolving scroll members 101 and 102 face each other in a manner such that the spiral walls 101*b* and 102*b* are engaged with each other with a phase difference of 180°, and the revolving scroll member 102 is made to revolve around the axis of the fixed scroll member 101 via the shaft 103, so that the capacities of compression chambers, which are formed between the spiral walls 101*b* and 102*b*, are gradually reduced and the fluid in the compression chambers is compressed, thereby finally discharging the high-pressure fluid from a discharge port 104 which is provided in a center portion of the fixed end plate 101*a*.

In this scroll compressor, the capacity of a crescent-shaped closed space formed at the outermost area of the spiral corresponds to the capacity for the introduced fluid which is gradually compressed. Therefore, in order to increase the capacity for the introduced fluid, that is, the capacity for the fluid to be compressed, the number of coils (or turns) of the spiral must be increased, or alternatively, the height of the spiral walls must be increased.

However, an increase in the number of turns of the spiral leads to an increase in the diameter of the compressor, and an increase in the height of the spiral walls causes a decrease in the rigidity of the spiral walls relative to the pressure of the compressed fluid.

Japanese Patent No. 1296413 (refer to Japanese Examined Patent Application, Second Publication No. Sho 60-17956) discloses an example structure for solving these problems. FIGS. 6A and 6B are perspective views which respectively show a fixed scroll member 1 and a revolving scroll member 2 employed in this example. The fixed scroll member 1 has an end plate 1*a* and a spiral wall 1*b* which is formed on a face of the end plate 1*a*. Similarly, the revolving scroll member 2 has an end plate 2*a* and a spiral wall 2*b* which is formed on a face of the end plate 2*a*. In the above faces of the end plates 1*a* and 2*a*, step portions 3 and 3 are each formed, and in each step portion 3, the side closer to the center of the spiral is higher than the side closer to the outer end of the spiral. In addition, step portions 4 and 4 corresponding to the step portions 3 and 3 are each formed in the upper ends of the spiral walls 1*b* and 2*b* of the scroll members 1 and 2. In each step portion 4, the side closer to the center of the spiral is lower than the side closer to the outer end of the spiral.

Therefore, the above-explained scroll compressor has a feature that the spiral walls and end plates are respectively formed to have step portions, that is, in the spiral walls, the outer side (of the spiral) is higher and the center side is lower, while in the end plates, the outer side is lower and the center side is higher so as to correspond to the spiral walls.

FIG. 7 shows the engagement state in which the spiral walls 1*b* and 2*b* are engaged with each other with a phase difference of 180°. As shown in the figure, compression chambers C2 and C3 and the like are formed between the spiral walls 1*b* and 2*b*, by the end plates and/or the slide planes of the step portions of the end plates and spiral walls. In this state, when the revolving scroll member 2 revolves around the axis of the fixed scroll member 1, the capacities of the compression chambers gradually decrease, thereby compressing the relevant fluid.

In the above scroll compressor, the height of the compression chamber closer to the outer side of the spiral is relatively high; thus, the capacity for the introduced fluid can be increased without increasing the outer diameter of the compressor. In addition, the height of the compression chamber closer to the center can be low, so that high rigidity of the walls can be obtained.

However, in comparison with general scroll compressors having walls of a uniform height, each step portion 3 and the corresponding step portions 4 partially slide on each other, that is, the engagement of the step portions occurs. Therefore, even if a very slight gap between the engaged portions exists due to the working or assembling tolerance of the scroll members, the fluid may leak through the gap, and thus the compression efficiency is reduced.

In addition, in order to solve the above problem, the scroll members should be manufactured to a very high accuracy; thus, the productivity is very low and the manufacturing cost is very high.

SUMMARY OF THE INVENTION

In consideration of the above circumstances, the present invention relates to scroll compressors, which comprise scroll members having step portions, and an object of the present invention is to provide a scroll compressor for reducing leakage of the fluid occurring at the step portions as much as possible and improving the compression efficiency. Another object of the present invention is to provide a scroll compressor which has less leakage of the fluid and can realize a high compression efficiency without increasing the precision in the manufacture of the scroll members.

Therefore, the present invention provides a scroll compressor comprising:

a fixed scroll member which has an end plate and a spiral wall provided on a face of this end plate and is fixed as a specific position; and a revolving scroll member which has an end plate and a spiral wall provided on a face of this end plate and is supported in a manner such that the spiral walls are engaged with each other and the revolving scroll member can revolve while rotation is prohibited, wherein:

the face of each scroll member, on which the spiral wall is provided, is divided into a plurality of areas which include a high portion closer to the center of the spiral, an adjacent low portion closer to the outer end of the spiral, and a step portion formed at the boundary of the high and low portions, where the high portion is higher than the low portion;

the edge of each spiral wall has a low edge which corresponds to the high portion and is closer to the center of the spiral, a high edge which corresponds to the low portion and is closer to the outer end of the spiral, and a step portion formed at the boundary of the high and low edges;

when the scroll members are engaged with each other, the end plates, the spiral walls, and the step portions partially contact with each other, so that closed spaces are generated between the scroll members;

the revolving scroll member is made to revolve so that the closed spaces gradually move from the outer side to the center side of the spiral and the capacities of the closed spaces are gradually reduced and a fluid in the closed spaces is compressed;

between the engaged scroll members, a high-pressure space which communicates with a discharge chamber is formed close to the center of the spiral, and among contact points at which the spiral walls of both scroll members contact with each other immediately before the innermost closed space communicates with the high-pressure space, the innermost contact point is defined as a base point;

the angular distance from the base point to the outer end of each spiral wall, measured along the inner-peripheral face of the spiral wall, is approximately $4\pi$ rad; and the angular distance from the base point to the step portion of each end plate, measured along the inner-peripheral face of the corresponding spiral wall, is equal to or more than approximately $3\pi$ rad.

According to the above structure, each step portion can be placed in a preferable area of the scroll members. Therefore, it is possible that after the moment when the innermost closed space (called the first closed space) communicates with the high-pressure space (which communicates with the discharge chamber), the step portions do not participate in the formation of the first closed space. The high-pressure fluid reversely flows from the high-pressure space due to the communication of the first closed space with the high-pressure space, and the pressure of the fluid in the first closed space increases. Accordingly, even when the differential pressure between the first closed space and the second closed space (which is adjacent to the first closed space and is placed closer to the outer end of the spiral) increases, the step portions do not participate in the formation of the first closed space; thus, the leakage of the fluid due to the presence of the step portions can be avoided. That is, the step portions may participate in the formation of the second closed space or more distant closed spaces, thereby reducing the leakage of the fluid due to the presence of the step portions as much as possible and improving the compression efficiency. Such an improved compression efficiency can be realized without improving the precision in the manufacture of the scroll members.

BRIEF DESCRIPTION OF THE DRAWINGS

FIG. 4A is an enlarged view of area A in FIG. 3, while

DESCRIPTION OF THE PREFERRED EMBODIMENTS

Hereinafter, an embodiment of the scroll compressor according to the present invention will be explained with reference to the drawings. The present invention is not limited to this embodiment. In addition, portions other than the scroll members have the same structures as those of the above-explained conventional scroll compressor; thus, detailed explanations thereof are omitted and the structure of the scroll members which are distinctive features of the present invention, in particular, the position where each step portion is formed, will be explained in detail below.

Figure 1:
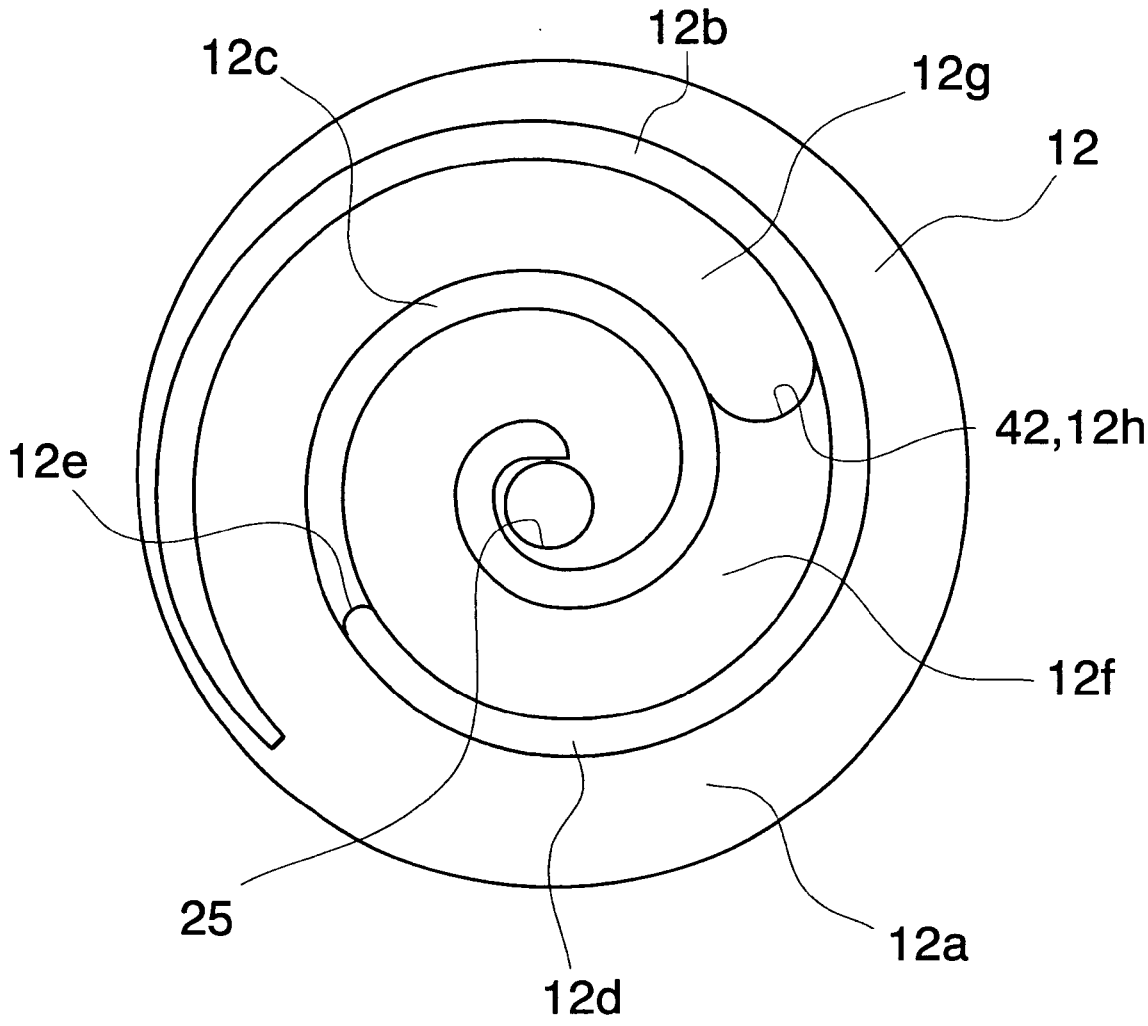
FIG. 1 is a view showing a fixed scroll member as a constituent of the scroll compressor of an embodiment according to the present invention, which is viewed from a face on which a spiral wall is formed.
Figure 2:
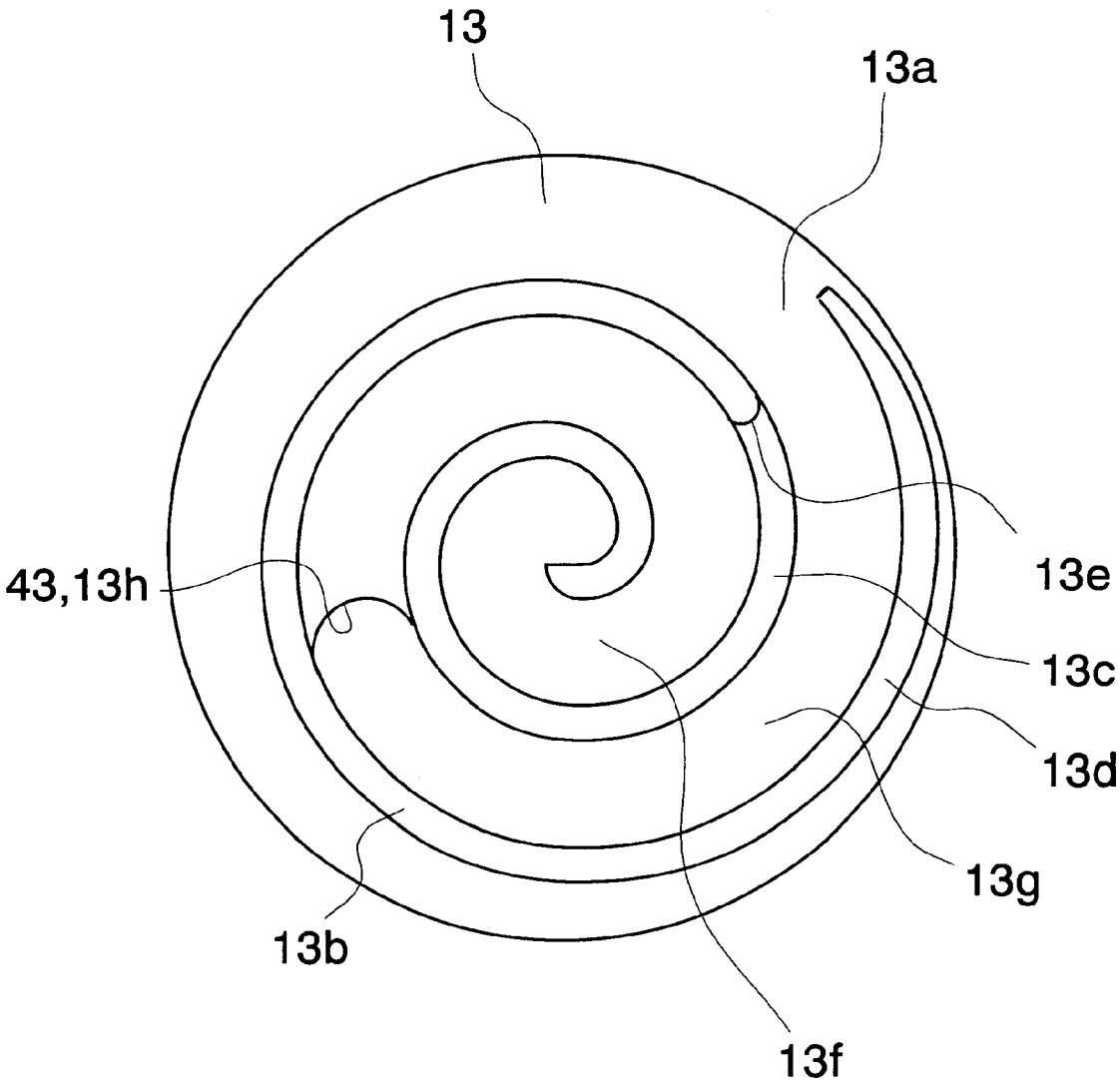
FIG. 2 is a view showing a revolving scroll member as another constituent of the scroll compressor of the embodiment, which is viewed from a face on which a spiral wall is formed.
Figure 3:
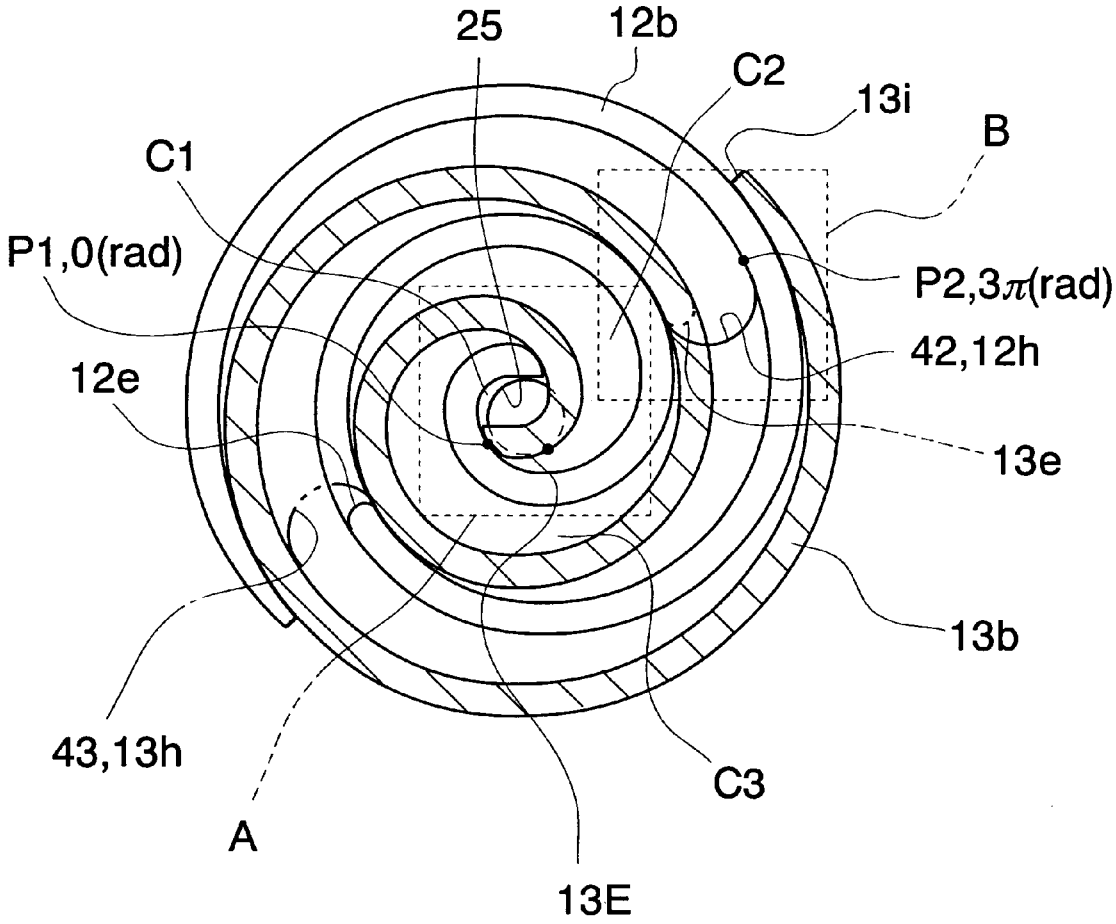
FIG. 3 is a cross-sectional view showing a state in which the fixed and revolving scroll members of the scroll compressor are engaged with each other, which is viewed from a cross section perpendicular to the axis of the discharge port towards the fixed scroll member.
Figure 4A:
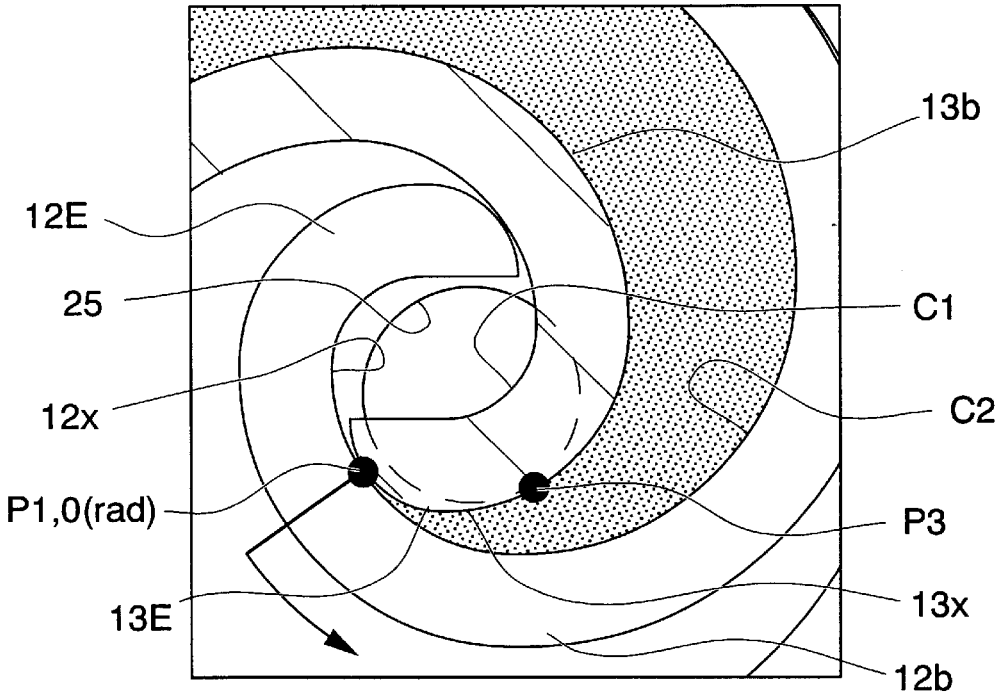
Figure 4B:
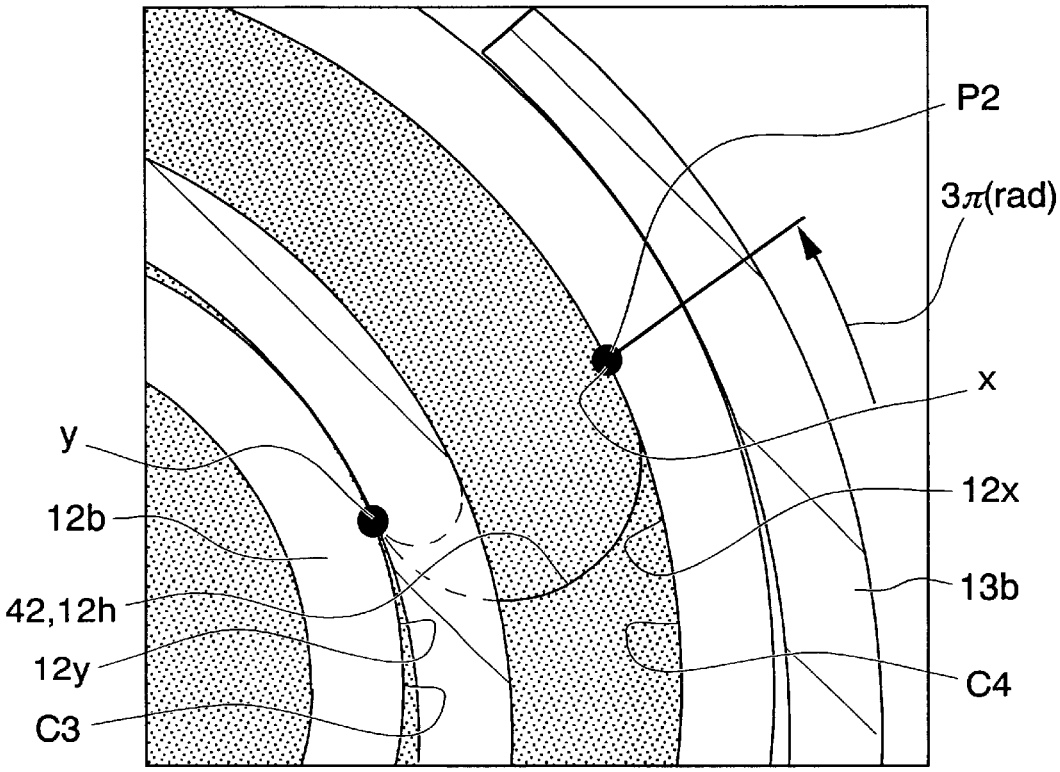
FIG. 4B is an enlarged view of area B in FIG. 3.
Figure 5A:
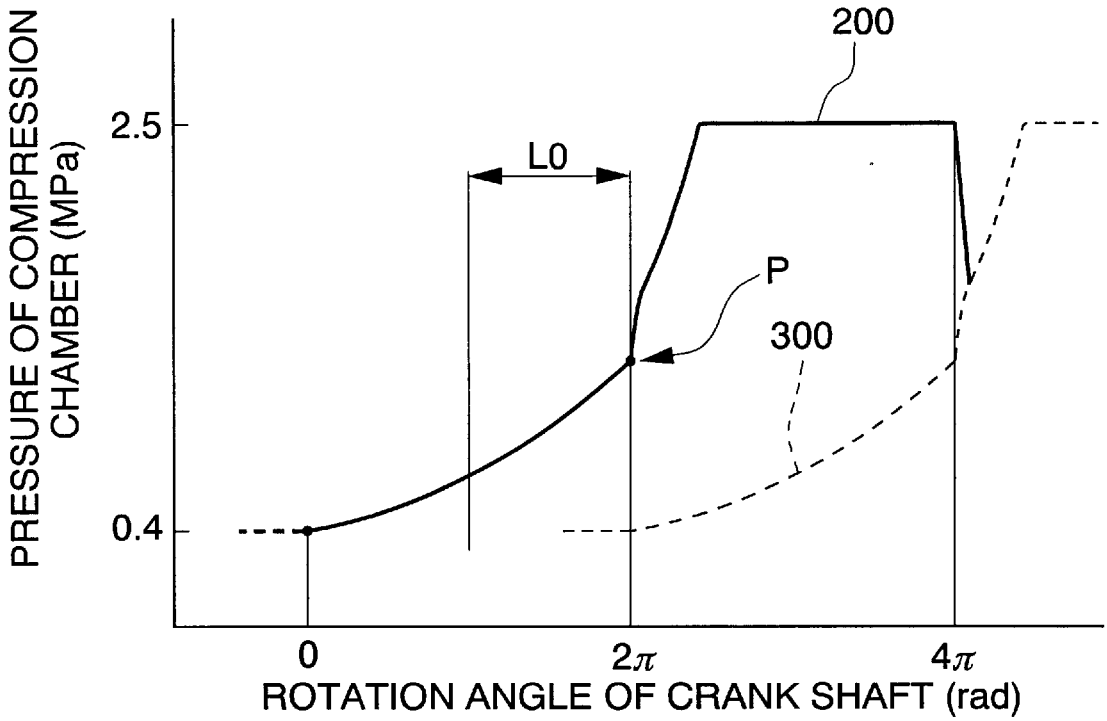
FIG. 5A is a graph showing changes in the pressure in each compression chamber versus the rotation angle of the revolving scroll member during the operation of the scroll compressor of the embodiment.
Figure 5B:
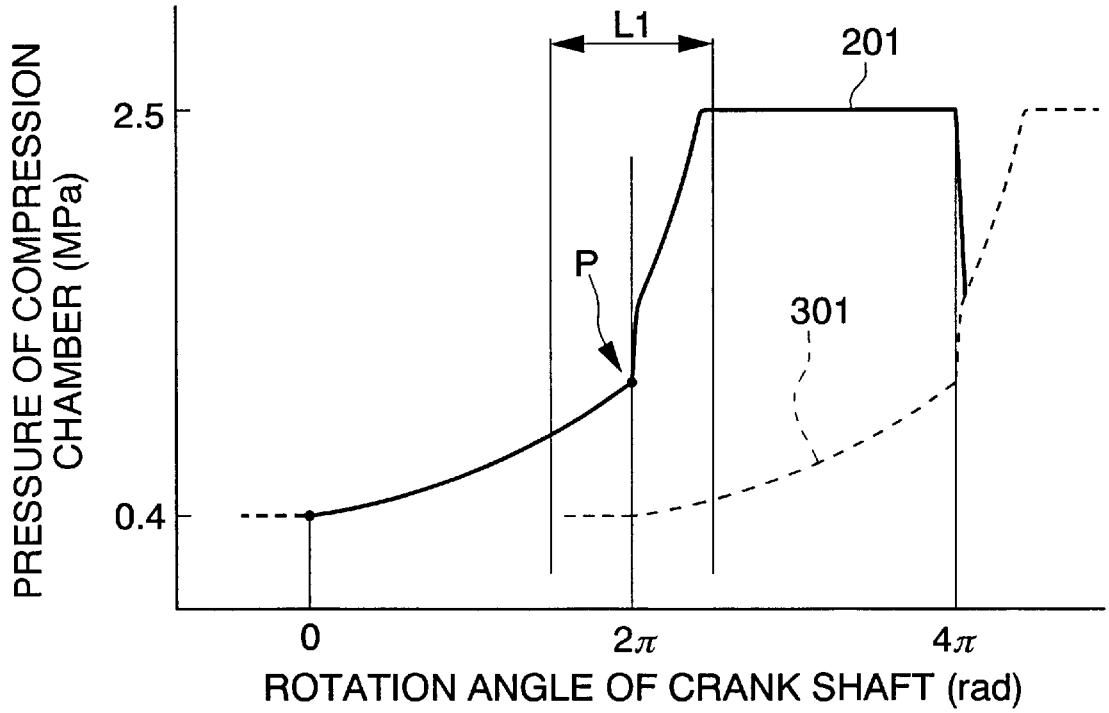
FIG. 5B is a graph showing changes in the pressure in each compression chamber along the rotation angle of the revolving scroll member during the operation of a conventional scroll compressor.
Figure 6A:
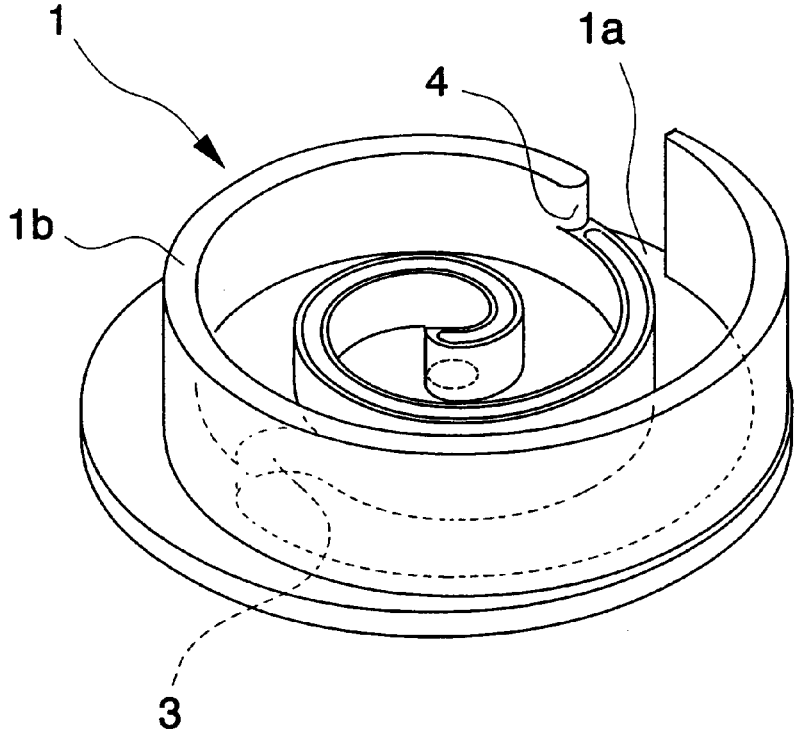
Fig. 6A PRIOR ART
FIGS. 6A and 6B are perspective views which respectively show a fixed scroll member and a revolving scroll member employed in a conventional scroll compressor.
Figure 6B:
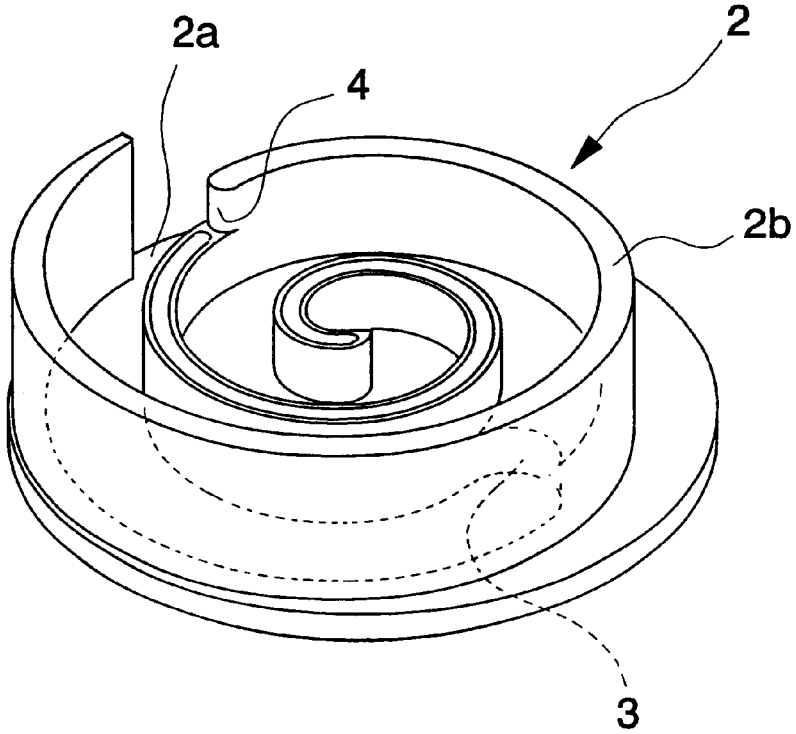
Fig. 6B PRIOR ART

FIG. 1 is a view showing a fixed scroll member as a constituent of the scroll compressor of the present embodiment, which is viewed from a face on which a spiral wall is formed. FIG. 2 is a view showing a revolving scroll member as another constituent of the scroll compressor of the present embodiment, which is viewed from a face on which a spiral wall is formed. FIG. 3 is a cross-sectional view showing a state in which the fixed and revolving scroll members are engaged with each other, which is viewed from a cross section perpendicular to the axis of the discharge port towards the fixed scroll member. FIG. 4A is an enlarged view of area A in FIG. 3, while FIG. 4B is an enlarged view of area B in FIG. 3. FIG. 5A is a graph showing changes in the pressure in each compression chamber versus the rotation angle of the revolving scroll member dung the operation of the scroll compressor of the present embodiment. FIG. 5B is a graph showing changes in the pressure in each compression chamber along the rotation angle of the revolving scroll member during the operation of a conventional scroll compressor.

As shown in FIG. 1, a spiral wall 12*b* is formed on an end plate 12*a* of a fixed scroll member 12, and the face on which the spiral wall 12*b* is provided has a shallow bottom face 12*f* closer to the center of the spiral and a deep bottom farce 12*g* closer to the outer end of the spiral. A step portion 42 is formed at the boundary of the shallow portion 12*f* and the deep portion 12*g*, and a joint wall 12*h* stands vertically with respect to the axis of the fixed scroll member 12, between the bottom faces 12*f* and 12*g*.

Additionally, the edge of the spiral wall 12*b* has a lower edge 12*c* closer to the enter of the spiral and a higher edge 12*d* closer to the outer end of the spiral. Therefore, a step portion is also formed between the adjacent edges 12*c* and 12*d* and a joint edge 12*e* is formed between the edges 12*c* and 12*d*, which is vertically formed with respect to the axis of the fixed scroll member 12.

As shown in FIG. 2, a revolving scroll member 13 has an almost mirror-symmetrical shape with respect to the fixed scroll member 12. More specifically, an end plate 13*a* of the revolving scroll member 13 has a deep bottom face 13*g* and a shallow bottom face 13*f* are formed, which respectively correspond to the higher edge 12*d* and the lower edge 12*c* of the fixed scroll member 12, and a step portion 43 is formed between the deep bottom face 13*g* and the shallow bottom face 13*f*. A joint wall 13*h*, which stands vertically, is also formed at the boundary between the bottom faces 13*f* and 13*g*.

In addition, a spiral wall 13*b* of the revolving scroll member 13 has a higher edge 13*d* and a lower edge 13*c* which respectively correspond to the deep bottom fare 12*g* and the shallow bottom face 12*f* of the end plate 12*a* of the fixed scroll member 12, and at the boundary of the higher and lower edges 13*c* and 13*d*, a joint edge 13*e* is formed, which stands vertically with respect to the axis of the revolving scroll member 13.

When the revolving scroll member 13 is engaged with the fixed scroll member 12, the lower edge 13*c* contacts the shallow bottom face 12*f* and the higher edge 13*d* contacts the deep bottom face 12*g*. Simultaneously, the higher edge 12*d* contacts the deep bottom face 13*g* and the lower edge 12*c* contacts the shallow bottom face 13*f*. Accordingly, as shown in FIG. 3, the space between the fixed and revolving scroll members 12 and 13 is divided into a plurality of compression chambers by the end plates 12*a* and 13*a* (which face each other) and the spiral walls 12*b* and 13*b*. According to the revolution of the revolving scroll member 13, the capacities of these compression chambers are gradually reduced while the compression chambers gradually move from the outer side to the center side of the spiral, thereby compressing the fluid, and finally, the high-pressure fluid is discharged from a discharge port 25 which is provided in a center area of the end plate 12*a* of the fixed scroll member 12.

Below, the positions of the step portions 42 and 43 (which are distinctive features of the present invention) will be explained. In the fixed scroll member 12 and the revolving scroll member 13, the spiral walls 12*b* and 13*b* have symmetrical forms with each other, and the end plates 12*a* and 13*a* also have symmetrical forms. Therefore, the structure of the fixed scroll member 12 will be explained in detail, and a detailed explanation of the structure of the revolving scroll member 13 (i.e., the position of the step portion 43) is omitted.

FIG. 3 shows a state in which the fixed scroll member 12 and the revolving scroll member 13 are engaged with each other. Between the spiral walls 12*b* and 13*b*, a high-pressure chamber C1 which communicates with the discharge port 25 of the fixed scroll member 12, and two crescent-shaped compression chambers C2 and C3 (corresponding to the closed spaces of the present invention) are formed, where the compression chambers C2 and C3 are each adjacent to the high-pressure chamber C1. FIG. 3 shows a specific state immediately before the compression chamber C2 is communicated with the high-pressure chamber C1. In the following explanations, this state will be called the "engagement state immediately before communication with the high-pressure space". In this state, a sealed position between the high-pressure chamber C1 and the compression chamber (i.e., closed space) C2, that is, a sealed point between spiral walls 12*b* and 13*b*, is defined as a base point P1.

In the scroll members of the present embodiment, the spiral end 13*i* of the spiral wall 13*b* is away from the base point P1 by an angular distance of 4π rad measured along the inner-peripheral face of the spiral wall 13*b*. Therefore, the number of coils (or turns) of the spiral is relatively small. In addition, P2 is a position away from the base point P1 by an angular distance of 3π rad measured along the inner-peripheral face of the spiral wall 12*b*, and the angular distance between the base point PI and the step portion 42 is 3π rad or more, that is, the step portion 42 is positioned at P2 or a more distant point.

As explained above, the base point P1 is defined based on the state immediately before the compression chamber C2 communicates with the discharge port 25 (i.e., high-pressure chamber C1) at point P3 (see FIG. 4A). Therefore, if the revolving scroll member 13 further revolves very slightly, this communication occurs. Under this "engagement state immediately before communication with the high-pressure space", the inner-peripheral face 12*x* of an end portion 12E at the center side of the spiral wall 12*b* and the outer-peripheral face 13*x* of an end portion 13E at the center side of the spiral wall 13*b* make linear contact at the base point P1 (i.e., "point contact" in the observation direction of FIG. 4A). This base point P1 is a starting point for measuring the angular distance and defining the above position P2; thus, the position of the base point P1 is defined as 0 rad.

When a spiral figure is drawn from the base point P1 along the inner-peripheral face 12*x* towards the outer end of the spiral wall 12*b* (see FIG. 4B), the line between the base curve for drawing an involute which corresponds to the spiral figure and the base point P1 on the involute is defined as 0 rad. The angular distance from the base point P1 to the position P2 is 3π rad. In the spiral wall 12*b*, the contact position x between the step portion 42 and the inner-peripheral face 12*x* is placed at P2 or a position closer to the outer end of the spiral. In FIG. 4, the step portion 42 is placed at the innermost position under this condition, that is, the position P2 overlaps with the contact position x.

In FIG. 4B, reference character 12*y* indicates the outer peripheral face of the inner wall adjacent to the wall including the point P2, and reference characters C3 and C4 indicate adjacent compression chambers. The contact position y between the step portion 42 and the outer-peripheral face 12*y* is placed on the line between the above base curve (for the involute) and the contact position x. The step portion 42 has a semicircle form which has two end points corresponding to the contact positions x and y. Here, the contact position y does not overlap with the compression chamber C3 and thus no portion of the step portion 42 is present in the area of the compression chamber C3 under the above-explained engagement state immediately before communication with the high-pressure space.

Figure 7:
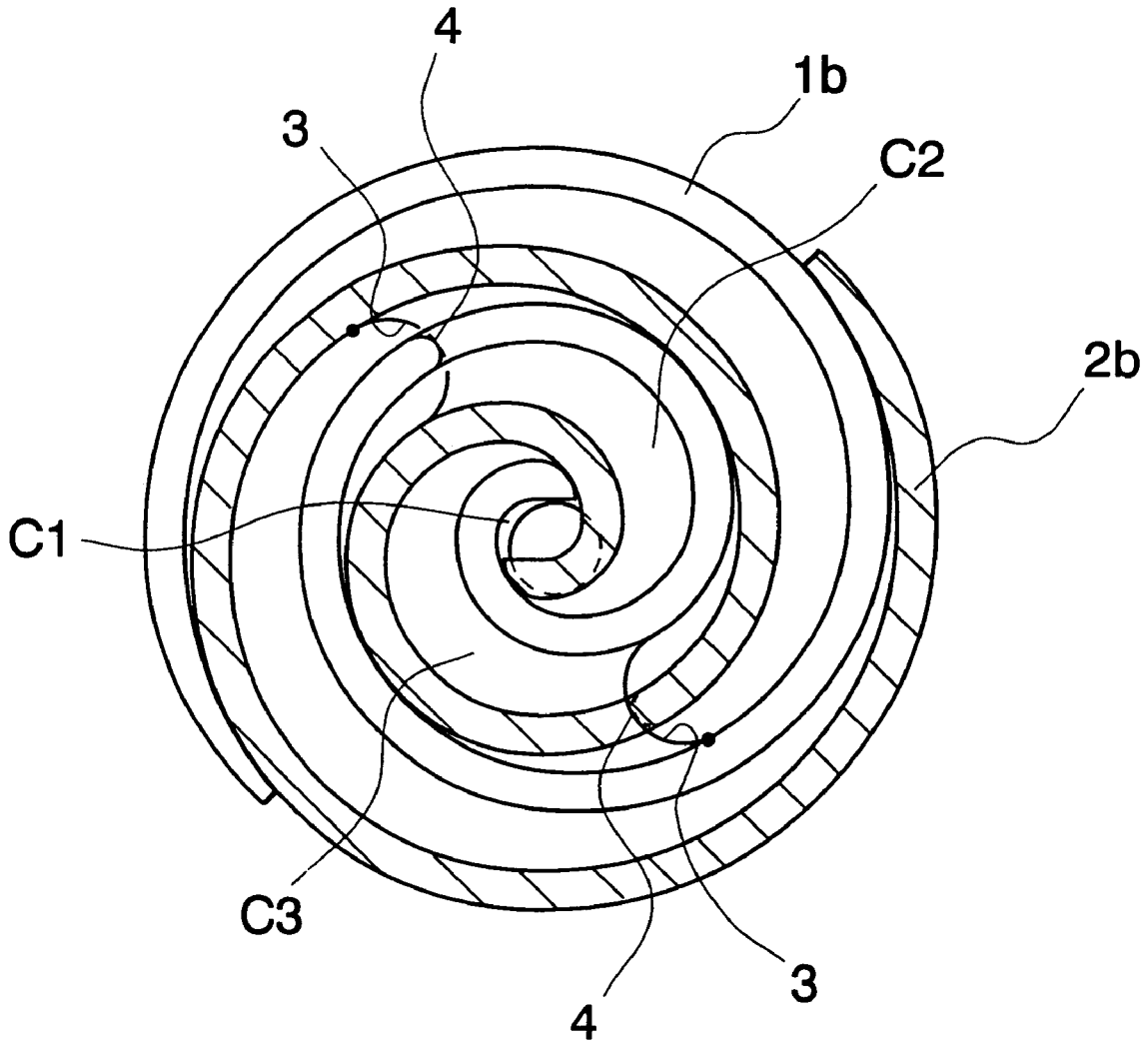
Fig. 7 PRIOR ART
FIG. 7 is a cross-sectional view showing a state in which the fixed and revolving scroll members of the conventional scroll compressor are engaged with each other, which is viewed from a cross section perpendicular to the axis of the discharge port towards the fixed scroll member.
Figure 8:
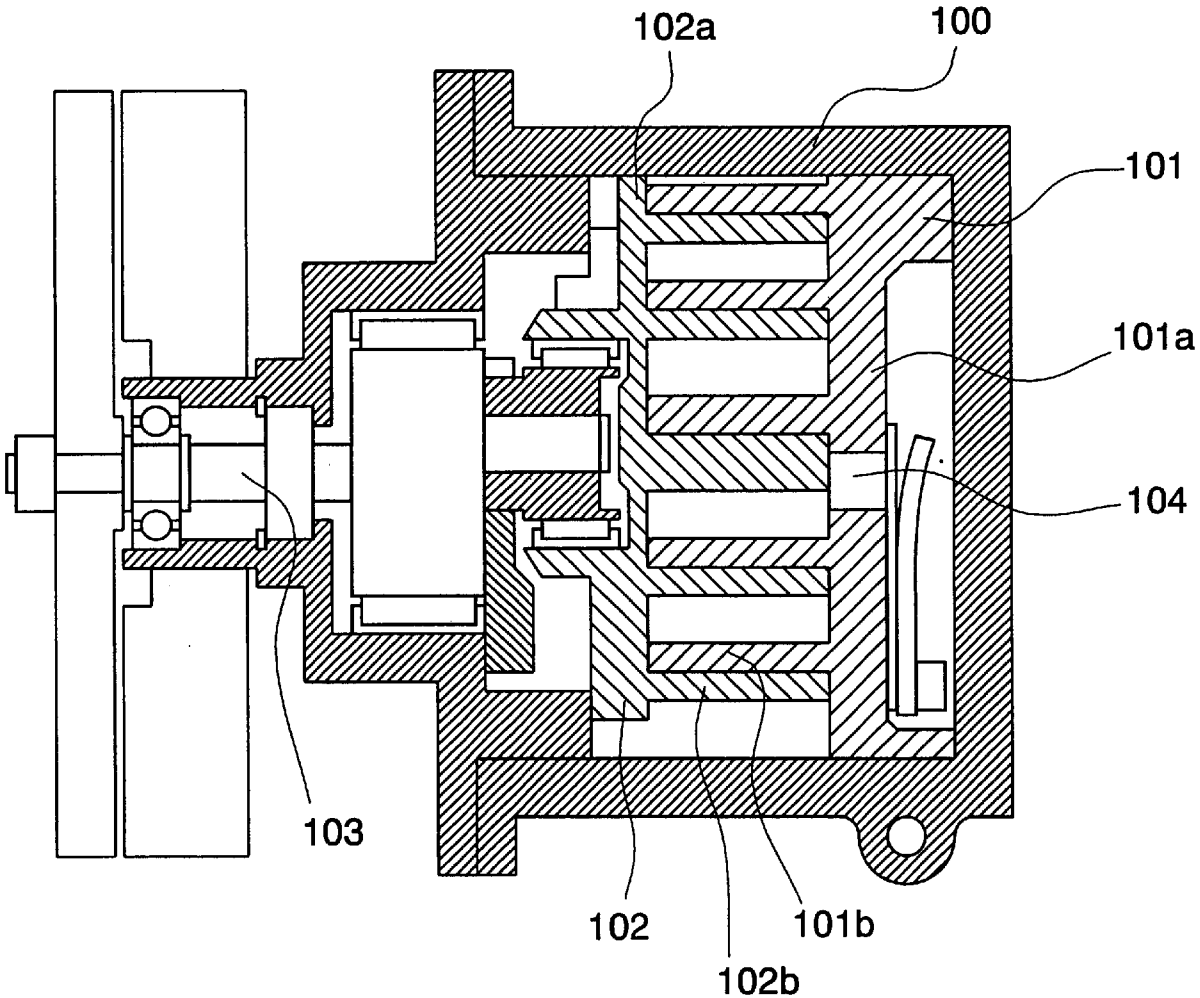
Fig. 8 PRIOR ART
FIG. 8 is a cross-sectional view of the general structure of the conventional scroll compressor.

FIGS. 5A and 5B are diagrams for explaining the effects obtained by the scroll compressor having the above-explained structure. FIG. 5A shows a correlation between the pressure of each compression chamber and the rotation angle of the crank shaft in the present invention, while FIG. 5B shows a correlation between the pressure of each compression chamber and the rotation angle of the crank shaft in a structure in which the step portions 42 and 43 are shifted to the center side of the spiral (i.e., corresponding to the conventional example as shown in FIG. 7). In the operation conditions of the compressor which were employed, the defined low pressure is 0.4 Mpa while the defined high pressure is 25 Mpa.

The rate of change of the capacity of the compression chamber depends on the positions of the step portions 42 and 43; thus, even with the same rotation angle of the crank shaft, the rising point P of the pressure of the compression chamber changes according to the positions of the step portions 42 and 43. In FIG. 5A, the line indicated by reference numeral 200 (i.e., solid line) shows the variation of the pressure when the step portions 42 and 43 according to the present invention are formed. If the positions of these step portions 42 and 43 are shifted along the spiral towards the center side so as to have the structure shown in the conventional example (refer to FIG. 7), the variation of the pressure is shown by the line 201 (i.e., solid line) in FIG. 5B.

Each point P in FIGS. 5A and 5B corresponds to the above-explained engagement state immediately before communication with the high-pressure space. In the pressure range higher than P (i.e., the right side of P in each figure), the compression chamber communicates with the high-pressure chamber C1, and accordingly, the high-pressure fluid remaining in the high-pressure chamber C1 reversely flows into the compression chamber. As a result, the pressure of the compression chamber increases suddenly, that is, the pressure of the compression chamber suddenly increases immediately after the point P.

The line indicated by reference numeral 300 (i.e., dotted line) shows a variation of the adjacent compression chamber which is closer to the outer side of the spiral (i.e., adjacent to the compression chamber having the variation of pressure indicated by reference numeral 200) in the scroll compressor of the present embodiment. Similarly, the line indicated by reference numeral 301 (i.e., dotted line) shows a variation of the adjacent compression chamber which is closer to the outer side of the spiral (i.e., adjacent to the compression chamber having the variation of pressure indicated by reference numeral 201) in the scroll compressor of the conventional example.

With reference to FIGS. 5A and 5B, the distinctive features of the present embodiment in comparison with the conventional example will be explained. In the conventional scroll compressor shown by FIG. 5B, the range in which the engaged portions at the step portions 42 and 43 (corresponding to the step portions 3, 3 in FIG. 7) participate in the formation of the compression chambers is L1, which corresponds to a rotation angle of the crank shaft of 180 degrees. Conversely, in the scroll compressor according to the present invention shown by FIG. 5A, the range in which the engaged portions at the step portions 42 and 43 participate in the formation of the compression chambers is L0, which corresponds to a rotation angle of the crank shaft of 180 degrees.

Each engaged portion at the step portions 42 and 43 has a minute gap due to a tolerance for the mechanical processing or assembly. The leakage of fluid through the gap corresponds to the differential pressure of the fluid within the range where the engaged portions at the step portions 42 and 43 participate in the formation of the compression chambers, that is, (i) differential pressure $\Delta P1$ between the lines 201 and 301 in the conventional example and (ii) differential pressure $\Delta P0$ between the lines 200 and 300 in the present embodiment within that range. With reference to FIGS. 5A and 5B, it is obvious that $\Delta P1 > \Delta P0$. Accordingly, in the present embodiment, it is possible to reduce the leakage of fluid through a gap of the engaged portions at the step portions 42 and 43 (which are provided in the scroll members), thereby improving the compression efficiency.

That is, in the scroll compressor having the step portions 42 and 43 of the present embodiment, the step portion 42 is placed at the position P2 or a position closer to the outer end of the spiral, where the angular distance from the base point P1 to the position P2 (measured along the inner-peripheral face of the spiral wall 12*b*) is $3\pi$ rad, and similarly, the step portion 43 is placed at the corresponding position ($3\pi$ rad) or a more distant position. According to this structure, as shown in FIG. 5A, the engaged portions at the step portions 42 and 43 do not relate to the formation of the compression chambers in the pressure range higher than the point P, where the pressure of the compression chamber is very high. Therefore, the leakage of fluid through a gap at the step portions 42 and 43 can be reduced as much as possible, thereby improving the compression efficiency.

In the present embodiment, the angular distance from the base point P1 to the spiral end 13*i* measured along the inner-peripheral face of the spiral wall 13*b* is $4\pi$ rad. However, practically, this angular distance may be selected from $3.3\pi$ rad to $5\pi$ rad so as to obtain similar effects of the present invention. In addition, similar variations can be applied to the spiral wall 12*b*.

Also in the present embodiment, the angular distance from the base point P1 to the step portion 42 measured along the inner-peripheral face of the spiral wall 12*b* is $3\pi$ rad or more. However, if this angular distance is slightly smaller than $3\pi$ rad (e.g., $2.7\pi$ rad, that is, $0.3\pi$ rad closer to the center of the spiral), the corresponding reduction of the compression efficiency is small and effects similar to those of the present invention can also be obtained. In addition, similar variations can be applied to the step portion 43.

What is claimed is:

1. A scroll compressor comprising:

a fixed scroll member which has an end plate and a spiral wall provided on a face of this end plate and is fixed at a specific position; and a revolving scroll member which has an end plate and a spiral wall provided on a face of this end place and is supported in a manner such that the spiral walls are engaged with each other and the revolving scroll member can revolve, wherein:

the face of the end plate of each scroll member, on which the spiral wall is provided, is divided into a plurality of areas which include a high portion closer to the center of the spiral, an adjacent low portion closer to the outer end of the spiral, and a step portion formed at the boundary of the high and low portions, wherein the high potion is higher than the low portion;

the edge of each spiral wall has a low edge which corresponds to the high portion and is closer to the outer end of the spiral, a high edge which corresponds to the low portion and is closer to the outer end of the spiral, and a step portion formed at the boundary of the high and low edges;

when the scroll members are engaged with each other, the end plates, the spiral walls, and the step portions partially contact each other, so that closed spaces are generated between the scroll members;

the revolving scroll member is made to revolve so that the closed spaces gradually move from the outer end to the center of the spiral and the capacities of the closed spaces are gradually reduced and a fluid in the closed spaces is compressed;

between the engaged scroll members, a high-pressure space which communicates with a discharge chamber is formed close to the center of the spiral, and among contact points at which the spiral walls of both scroll members contact with each other immediately before the innermost closed space communicates with the high-pressure space, the innermost contact point is defined as a base point;

an angular distance from the base point to the outer end of each spiral wall, measured along the inner-peripheral face of the spiral wall, is approximately $4\pi$ rad; and an angular distance from the base point to the step portion of each end plate, measured along the inner-peripheral face of the corresponding spiral wall, is equal to or more than approximately $3\pi$ rad.

* * * * *